United States Patent [19]

Waelder

[11] 4,138,962

[45] Feb. 13, 1979

[54] DEVICE FOR CONTROLLING THE SWINGING OF THE BOOM OF A SAILBOAT

[76] Inventor: Ernest Waelder, Avenue Alfred de Vigny 20, Villa Reve d'Azur, 06300 Nice, France

[21] Appl. No.: 823,822

[22] Filed: Aug. 11, 1977

[30] Foreign Application Priority Data

Sep. 17, 1976 [FR] France ..... 76 28403

[51] Int. Cl.[2] ..... B63H 9/08

[52] U.S. Cl. ..... 114/102

[58] Field of Search ..... 114/39, 97, 101, 102; 254/175, 190 R, 192, 197

[56] References Cited

U.S. PATENT DOCUMENTS

| | | | |
|---|---|---|---|
| 1,242,636 | 10/1917 | Ankrom | 254/197 |
| 1,365,951 | 1/1921 | Rapp | 254/197 |
| 1,379,868 | 5/1921 | Kelsey | 254/197 |
| 3,972,300 | 8/1976 | Adamski | 114/39 |

FOREIGN PATENT DOCUMENTS

| | | | |
|---|---|---|---|
| 736155 | 6/1943 | Fed. Rep. of Germany | 254/190 R |
| 1347447 | 2/1974 | United Kingdom | 114/102 |

*Primary Examiner*—Stephen G. Kunin

*Attorney, Agent, or Firm*—Young & Thompson

[57] ABSTRACT

A device for controlling the swinging of the boom of a sailboat, comprises a line fixed at its opposite ends to opposite gunwales of the boat and passing intermediate its ends about a sheave carried by the boom. The sheave can be non-rotatable, in which case braking effect is achieved by providing at least one dead turn of the line about the sheave. In this case, guides carried by the sheave are preferably provided for preventing overlapping of the turns of the line. Alternatively, the sheave can be rotatable, in which case braking can be provided by brake shoes progressively applicable upon rising movement of the boom, which is the condition characteristic of greater wind pressure against the sail and hence greater tendency for the boom to swing quickly.

3 Claims, 4 Drawing Figures

Fig. 2
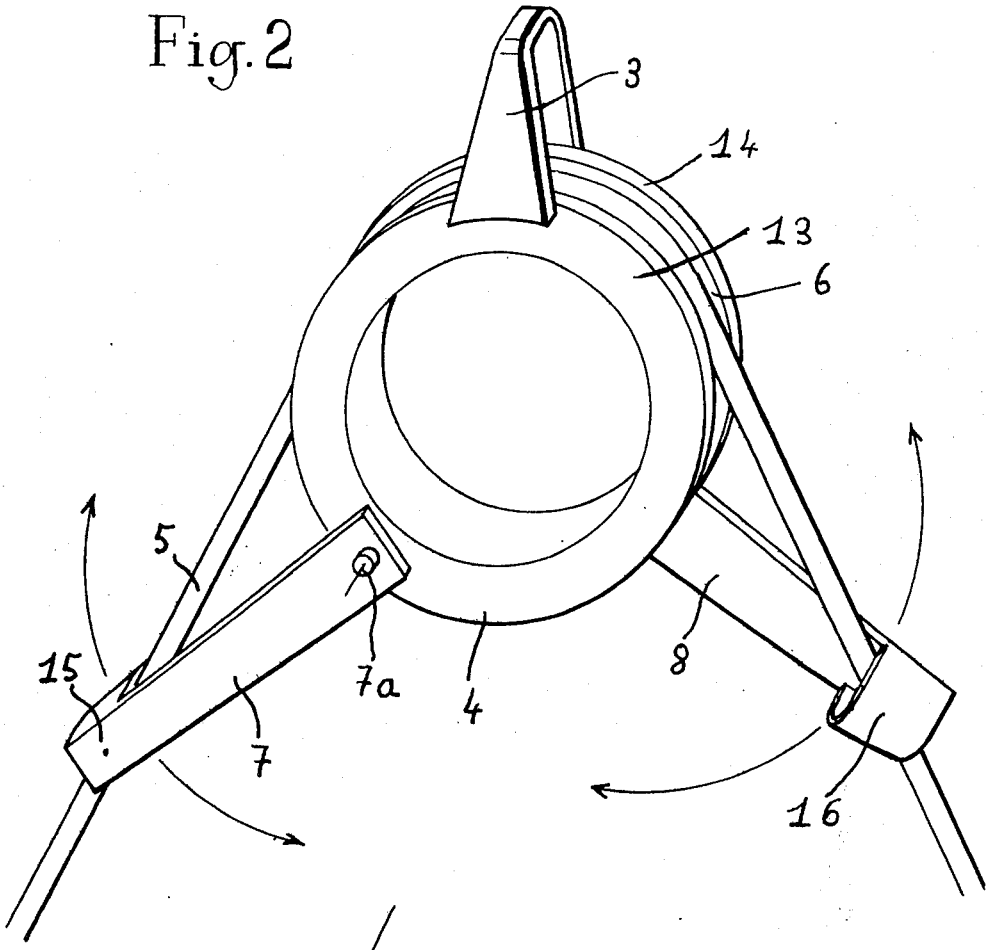
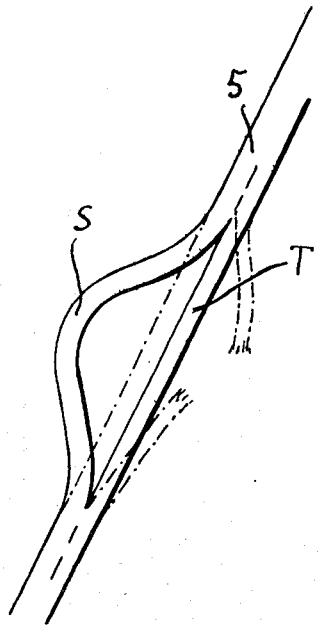
Fig. 3

DEVICE FOR CONTROLLING THE SWINGING OF THE BOOM OF A SAILBOAT

The object of the invention is to provide a device for controlling the vertical and horizontal swinging of the boom of a sailboat. The said device eliminates inopportune jibbing, the down-haul and the guying of the boom.

At the present, when a sailboat jibs inopportunely or spontaneously, the boom can move through an arc about the mast at great speed. These swinging movements are very dangerous and the impacts of the boom at the end of its travel are very violent. Generally one tries to limit the swinging of the boom with the sheet but this is not always possible, particularly if this is fully extended.

During jibbing the boom tends to lift. In an extreme case, the boom can lift right up to the mast, this being a so-called "Chinese jib". To prevent the boom lifting during jibbing, there are boom retaining devices or down-hauls which maintain the mast and boom almost at right angles.

The device constituting the object of the present invention eliminates all these inconveniences. In effect it controls the swinging of the boom by means of a brake which acts automatically and progressively depending on the strength of the wind. In addition the said device eliminates the boom down-haul and guying because it utilizes the upward thrust of the boom in particular; while by contrast, these two last-named devices prevent the boom lifting.

The device for controlling the swinging of the boom of a sailboat consists of a cord passing through at least three anchoring points forming a triangle, two fixed points being located in the region of each gunwale (port and starboard) and one point being situated under the boom; at least one of the points has a means for braking the cord designed to restrict its sliding movement when the boom swings to port or starboard, the two ends of the cord being fixed at one of the anchoring points after being passed through the other two points. The said cord can also have means allowing its tension to be regulated.

Preferably the device for controlling the swinging of the boom of a sailboat comprises a rope or line fixed at one point on one of the gunwales, this line then passing to a drum acting as a braking means and fixed under the boom and then being fixed to the other anchorage point mounted on the other gunwale. In the region of one of the gunwales at least one of the extremities of the line can pass to a return block fixed in the region of the said corresponding anchorage point, and thence to a winch or tackle making it possible to vary the tension of the said line passing through the three points. To improve the operation and efficiency of the device, it is also possible to incorporate means for guiding the line.

The attached drawings illustrate one form of embodiment of the invention given by way of non-limitative example together with variants of the braking means that can be used.

In the drawings:

FIG. 2 is a perspective view of a braking means mounted on the fixed block and of the braking means for the line.

FIG. 3 shows a safety warning device that can be fitted to the line.

Figure 1:
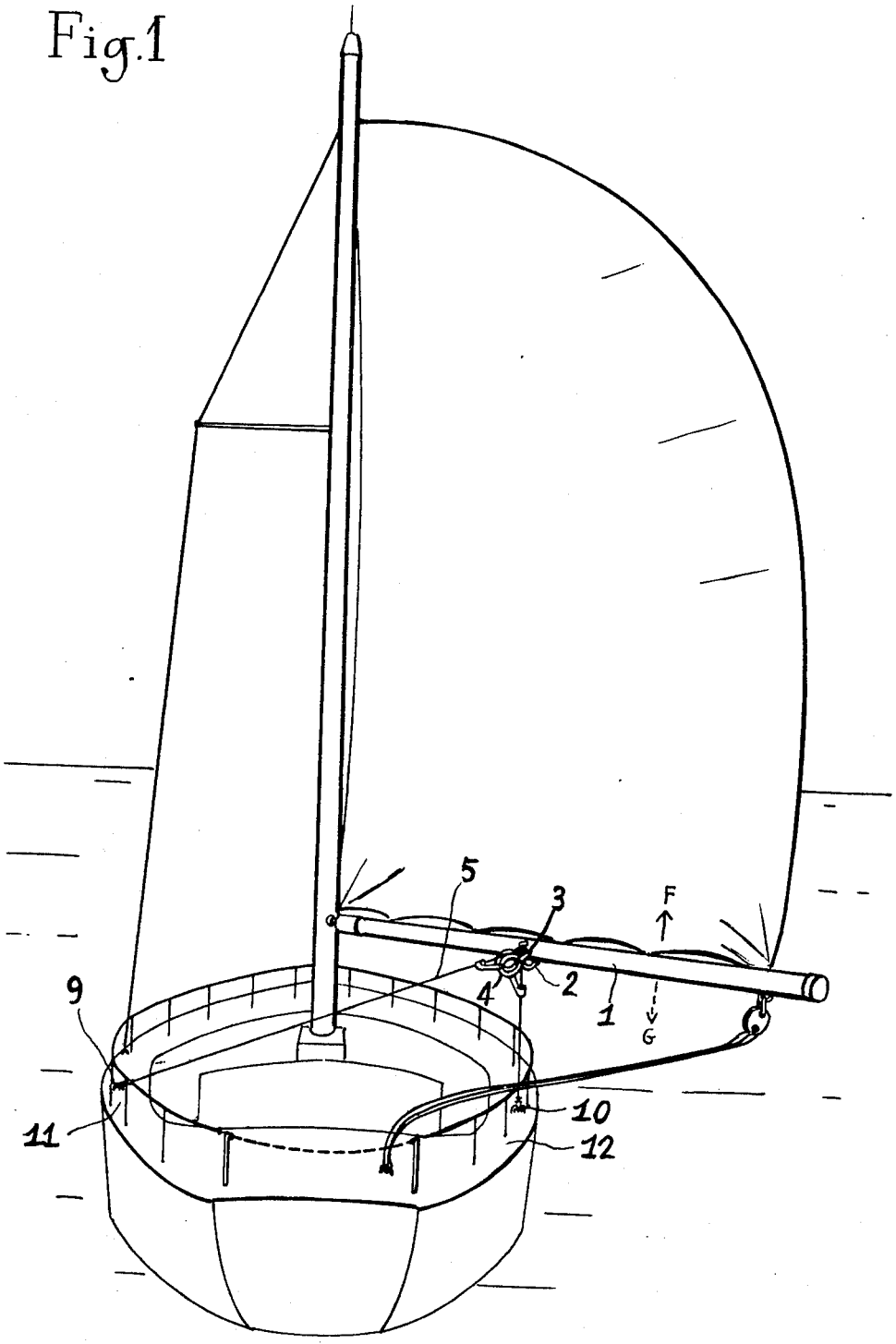
FIG. 1 shows the location of the device and its action on the boom of a sailboat.

Referring now to the drawings in greater detail, there is shown a sailboat embodying the present invention and in which the boom 1 has a ring 2 to which a non-rotatable sheave 4 can be secured by means of a stirrup 3. The sheave 4 has a groove 6 for passage of the line 5. In each side of the cheeks of the sheave 4 guiding means consisting of arms 7 and 8 ensure correct positioning of the line in the groove 6 of the sheave. The two arms 7 and 8 are carried by the sheave 4 and can pivot about their spindles *7a* and *8a* (not shown). The two extremities 9 and 10 of the line 5 are fixed respectively to the gunwales 11 and 12 of the sailboat.

The braking means at the sheave 4 is provided by one or more dead turns of the line 5 about the said sheave 4.

The invention will be easily understood by following the schematic drawing in FIG. 1. When the boom 1 has to move to starboard, without the device in accordance with the invention it describes an arc rapidly and violently. With the device in accordance with the invention the boom moves to starboard, as in the drawing, progressively, slowly and gently. The stronger the wind, the greater the tendency of the boom to lift in the direction arrow F. As the boom is secured with the sheave 4, it pulls on the latter; thanks to its dead turns, the line 5 bears on the groove of the sheave 4 over its entire contact surface; consequently it brakes the passage of the said line 5, which damps the swinging movement of the boom 1 about the mast. As soon as the boom sinks slightly again, the line 5 can slip around the sheave and allow the boom to swing and move into position progressively.

In the drawings in FIG. 1, the down-haul has been eliminated; in fact this device is no longer needed since the horizontal and vertical swinging movements of the boom are controlled by the said device. In the same way the boom guying can be omitted.

FIG. 2 shows the device in accordance with the invention in detail. The line 5 fixed by its two extremities 9 and 10 (not visible in FIG. 2) makes one dead turn in the groove 6 of the sheave 4. The cheeks 13 and 14 carry the arms 7 and 8, respectively, which can swing in the direction of the arrows shown. These guiding arms 7 and 8 have each a ring 15 and 16, respectively, at their ends through which the line 5 passes. Depending on the position of the boom, the arms 7 and 8 can thus adopt the most favorable position. The arms 7 and 8 improve the efficiency of the device; however the said device can operate without guide arms. In this case the line 5 can overlap itself in the groove 6 or the sheave 4; it is then sufficient to lower the boom slightly to allow it to pivot about the mast. Thus the guiding means prevents the line 5 overlapping itself in the groove 6.

It is possible to provide safety devices indicating the tension applied by the boom to the line 5 in the region of the extremities of said line 5.

In FIG. 3 the line 5 is shown diagrammatically together with a safety device indicating the tension. At this point the cord has a section T which serves to indicate the tension and can withstand a loading of 1,500 kg for instance; located parallel with this warning section T, a safety loop S capable of withstanding a tension of 2 tons can take the load should the indicating section T break. When the indicating section T is broken, sail must be reduced because the boat is carrying too much canvas. This device prevents the boom describing an arc suddenly and sweeping away everything in its path.

Figure 4:
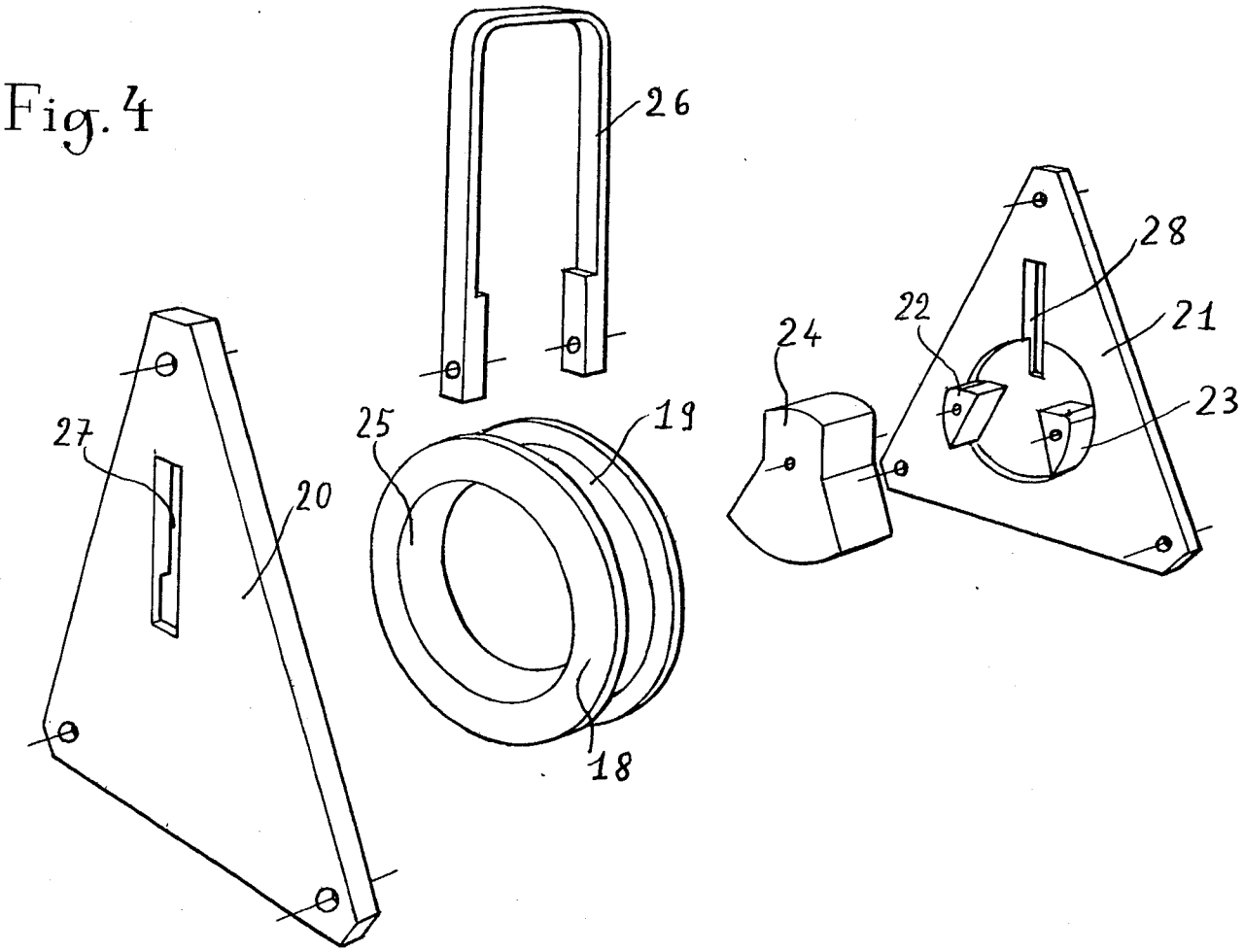
FIG. 4 is an exploded perspective view of the block and braking means.

FIG. 4 shows a block with its braking device. In this embodiment the sheave 18 can rotate, the line making a dead turn in the groove 19. The sheave has a braking device composed of two plates 20 and 21. The plate 21 has two pivotal shoes 22 and 23 which can be brought into action by an actuator 24. The said actuator 24 and the shoes 22 and 23 are disposed inside the sheave 18 and can thus be in contact with the wall 25 on which the shoes 22 and 23 will bear. The said shoes 22 and 23 are brought into action by means of the actuator 24 which can move vertically under the influence of the boom 1 to which it is linked by the stirrup 26. The stirrup and the actuator 24 can rise or fall by virtue of two windows 27 and 28 in the plates 20 and 21. This embodiment makes it possible to obtain greater braking effect on the line, firstly through the dead turn positioned on the groove and secondly because the sheave is then braked by the shoes 22 and 23. The operation of this embodiment is simple: when the boom tends to lift, it pulls on the stirrup 26 and thus raises the actuator 24 which forces the shoes 22 and 23 out against the inside wall 25 of the sheave 18 which can no longer turn.

Another form of embodiment, not shown, may be achieved by fitting a brake of the "Ferodo" type. In this case, when the boom is lifted, the brake linings grip in the groove of the sheave and come into contact with the line, restricting the sliding movement of the latter; the swinging movement of the boom about the mast will thus be progressively retarded.

The device in accordance with the invention can thus be used for all sails with a boom.

Naturally the sheave carried by the boom can be replaced by any other component permitting a sliding movement and braking by means of one or more dead turns, the said component thus being producible in any form such as a ring, shackle, etc.

Referring to FIG. 1, it will easily be understood, even though this is not shown, that the line 5 can pass through a return sheave (not shown) at one of the extremities 9 or 10 and thence to a winch or tackle allowing the user to regulate the tension of the line 5 so that jibbing takes place gently, progressively and completely automatically.

What is claimed is:

1. In a sailboat having a mast and a swingable boom extending rearwardly from the mast and a sail supported between the mast and the boom; the improvement comprising a device for controlling the swinging of the boom, comprising a line secured at its ends to opposite gunwales of the sailboat, a sheave non-rotatably carried by the boom about one-third of the way from the mast to the rear end of the boom, said line passing in at least one dead turn about said non-rotatable sheave.

2. A device for controlling the swinging of the boom of a sailboat, comprising a line secured at its ends to opposite gunwales of the sailboat, a rotatable sheave carried by the boom, said line passing about said rotatable sheave, and means actuated by rising movement of the boom increasingly to retard rotation of said sheave.

3. A device as claimed in claim 2, said retarding means comprising brake shoes swingable away from each other into braking contact with an inner surface of said sheave, and wedge means raised by rising movement of the boom to swing said shoes away from each other.

* * * * *